US009546086B2

(12) United States Patent
Samson

(10) Patent No.: US 9,546,086 B2
(45) Date of Patent: Jan. 17, 2017

(54) TAPPING DEVICE FOR AT LEAST ONE BAG-IN-BOX PACKAGING

(75) Inventor: Rainer Samson, Münster (DE)

(73) Assignee: SQUELL PRODUKTION UND HANDEL GMBH, Hockenheim (DE)

( * ) Notice: Subject to any disclaimer, the term of this patent is extended or adjusted under 35 U.S.C. 154(b) by 210 days.

(21) Appl. No.: 13/821,534

(22) PCT Filed: Sep. 9, 2011

(86) PCT No.: PCT/DE2011/001710

§ 371 (c)(1),
(2), (4) Date: May 1, 2013

(87) PCT Pub. No.: WO2012/041271

PCT Pub. Date: Apr. 5, 2012

(65) Prior Publication Data

US 2013/0213493 A1 Aug. 22, 2013

(30) Foreign Application Priority Data

Sep. 9, 2010 (DE) ..... 10 2010 044 861

(51) Int. Cl.
*B67D 3/00* (2006.01)
*B67D 1/14* (2006.01)
(Continued)

(52) U.S. Cl.
CPC ..... *B67D 1/1405* (2013.01); *B65D 77/067* (2013.01); *B67D 3/0009* (2013.01); *B67D 3/0025* (2013.01); *B67D 3/043* (2013.01); *Y10T 137/598* (2015.04)

(58) Field of Classification Search
CPC ..... B67D 2001/0827; B67D 3/0025; B65D 77/067
(Continued)

(56) References Cited

U.S. PATENT DOCUMENTS 2,274,409 A * 2/1942 Harbison ..... 222/183
2,590,177 A * 3/1952 Hopwood ..... 222/130
(Continued)

FOREIGN PATENT DOCUMENTS

DE 20 2007 002623 U1 6/2007
WO WO 97/34826 A1 9/1997
(Continued)

*Primary Examiner* — Kevin P Shaver
*Assistant Examiner* — Michael J Melaragno
(74) *Attorney, Agent, or Firm* — Muncy, Geissler, Olds & Lowe PC

(57) ABSTRACT

A tapping device for at least one bag-in-box packaging equipped with a tap valve, comprising at least one accommodating area for the bag-in-box packaging, wherein the accommodating area has at least one loading opening, at least one device door that closes the loading opening of the accommodating area, wherein the device door has at least one trigger of an operating apparatus that corresponds to the tap valve, and at least one beverage outlet associated with the tap valve, the operating apparatus has at least one operating element that acts from above on certain parts of the tap valve in order to operate the tap valve and at least one valve accommodating bearing is provided in the area of the loading opening, the at least one valve accommodating bearing having bearing surfaces for wings of the tap valve protruding at least on both sides of the valve housing.

8 Claims, 3 Drawing Sheets

(51) Int. Cl.
*B65D 77/06* (2006.01)
*B67D 3/04* (2006.01)

(58) Field of Classification Search
USPC . 222/505, 509, 105, 146.6, 183; 137/315.01
See application file for complete search history.

(56) References Cited

U.S. PATENT DOCUMENTS 2,781,153 A * 2/1957 Roberts ..... 222/183
3,325,058 A * 6/1967 West, Jr. ..... 222/146.5
4,133,456 A * 1/1979 Corini ..... 222/146.5
4,866,945 A * 9/1989 Bender et al. ..... 62/3.61
4,905,875 A * 3/1990 Straiton ..... 222/505
5,385,273 A * 1/1995 Eddy et al. ..... 222/185.1
5,542,584 A * 8/1996 Konar ..... 222/505
5,683,015 A * 11/1997 Lee ..... 222/146.6
5,775,364 A * 7/1998 Erb ..... 137/322
5,938,077 A * 8/1999 Erb ..... 222/41
6,056,157 A * 5/2000 Gehl et al. ..... 222/94
6,126,046 A * 10/2000 Baculy ..... 222/505
6,223,944 B1 * 5/2001 Gehl et al. ..... 222/94
6,247,620 B1 * 6/2001 Makainai ..... 222/185.1
6,708,741 B1 * 3/2004 Berry et al. ..... 141/362
7,076,966 B2 * 7/2006 Mullen ..... 62/337
8,091,735 B2 * 1/2012 Girard et al. ..... 222/54
8,567,645 B1 * 10/2013 Orr ..... 222/183
2009/0308492 A1 * 12/2009 Benvenuto et al. ..... 141/362
2010/0133298 A1 * 6/2010 Samson et al. ..... 222/146.6
2011/0036864 A1 * 2/2011 McKenna ..... 222/105
2012/0175387 A1 * 7/2012 Snell et al. ..... 222/505
2012/0318824 A1 * 12/2012 McKenna ..... 222/185.1

FOREIGN PATENT DOCUMENTS

WO WO 2006/125882 A2 11/2006
WO WO 2008/009438 A1 1/2008

* cited by examiner 5
3

21
2
24
23
27
26
22
28
25
33
35
31
8
34
29
32
30
17
20

3
4
2
21
24
23
27
33
26
31
35
29
28
34
32
30
17
20

TAPPING DEVICE FOR AT LEAST ONE BAG-IN-BOX PACKAGING

The invention relates to a tapping device for at least one "bag-in-box" packaging, which is equipped with a tap valve, comprising at least one accommodating area for the "bag-in-box" packaging, wherein the accommodating area encompasses at least one loading opening, comprising at least one device door, which closes the loading opening of the accommodating area and which encompasses at least one trigger of an operating apparatus, which corresponds to the tap valve and comprising at least one beverage outlet, which is associated with the tap valve.

Tapping devices of the known species are also identified as dispensers and serve in particular for providing chilled and non-chilled beverages at breakfast buffets and self-service counters. The beverages, which are accommodated in the "bag-in-box" packaging, can be tapped comfortably, as needed, with the help of the known tapping devices.

DE 20 2007 002 623 U1 describes a tapping device of the known species, for example, which has an accommodating area for the "bag-in-box" packaging, which encompasses at least one loading opening. The loading opening is in particular closed by means of a device door. In the area of its device door, the tapping device furthermore encompasses a tap button, which is to be operated and by means of which the tap valve of the "bag-in-box" packaging is operated via an operating apparatus, which is coupled to the tap button. An operation of the tap valve is thereby carried out from below, in that the parts of the valve piston, which protrude out of the valve housing on both sides, are moved upwards, for example in vertical direction. The tapping process can be started and can be stopped again by lifting or lowering the valve piston, respectively. The operating apparatus used herein has the disadvantage that only Vitop dispensing valves can be operated.

In contrast, an operating device for tap valves is known from EP 1 201 601 B1, wherein the cylindrical connecting piece of the tap valve is held in a valve accommodating bearing. An operating apparatus, which corresponds to the tap valve and which is formed from a lever mechanism comprising two levers, is arranged on the valve accommodating bearing. The levers are held so as to be movable relative to one another such that a displacement movement is created with one of the levers and the operation of the tap valve is carried out by means of the other lever. Such operating devices, however, cannot fulfil today's hygienic demands, which are made on above-identified tapping devices.

The invention is based on the object of improving a tapping device of the known species such that a simplified operation of "bag-in-box" packaging is possible by means of a wide range of tap valves.

The solution of the task is carried out by means of a tapping device according to the present application. Advantageous further developments and embodiments discussed in this specification.

In the case of a tapping device for at least one "bag-in-box" packaging, which is equipped with a tap valve, comprising at least one accommodating area for the "bag-in-box" packaging, wherein the accommodating area encompasses at least one loading opening, comprising at least one device door, which closes the loading opening of the accommodating area and which encompasses at least one trigger of an operating apparatus, which corresponds to the tap valve, and comprising at least one beverage outlet, which is associated with the tap valve, provision is made according to the invention for the operating apparatus to have at least one operating element, which acts from above on certain parts of the tap valve, for operating the tap valve, and for provision to be made in the area of the loading opening for at least one valve accommodating bearing, which has bearing surfaces for wings of the tap valve protruding at least on both sides of the valve housing.

Such a tapping device, which is embodied according to the invention, the operating apparatus of which encompasses an operating element arranged in particular above the tap valve, which thus acts on the corresponding tap valve parts from above, can be used in an advantageous manner for tapping beverages from "bag-in-box" packaging comprising different tap valve types. "Bag-in-box" packaging, which is either equipped with a Vitop dispensing valve or with a Rapak dispensing valve, which is also commercially available, can thus only be combined with one tapping device. In the case of a Vitop dispensing valve, a displacement movement of the tap valve housing takes place in response to the operation of the trigger, wherein the valve piston, which can typically be moved, is stationary. In contrast, the piston of the tap valve, which can be accessed from the top and which, based on the still stationary tap valve housing, carries out a relative movement thereto, is operated by means of the operating element in the case of a Rapak dispensing valve. The operating element of the operating apparatus, which is arranged above the tap valve, can be a setting cam, for example, which can be adjusted by means of an actuator. The electric actuation of the actuator is carried out by operating the trigger on the device door, which represents an advantageous possibility of operation.

A positionally secure and thus advantageous possibility for accommodating the tap valve of the "bag-in-box" packaging, which is equipped therewith, is thereby ensured via the valve accommodating bearing according to the invention. The bearing surfaces of the valve accommodating bearing thereby form a counter bearing for the wings of the tap valve, which stick out laterally on or which protrude from the valve housing, respectively. The wings of the valve piston in the case of a Vitop dispensing valve or the stationary wings on the valve housing of a Rapak dispensing valve, respectively, which are otherwise used for operating purposes, are accordingly locked at a predetermined height. In addition to the locking of the wings at a predetermined height, an advantageous orientation of the valve outlet of the tap valve to the beverage outlet of the tapping device is carried out simultaneously by means of the valve accommodating bearing. It goes without saying that the tapping device can also encompass a plurality of valve accommodating bearings in the area of a loading opening, so that the tapping device is designed for simultaneously tapping beverages from a plurality of "bag-in-box" packagings.

Advantageously, provision is made according to a further development of the invention for the valve accommodating bearing to be embodied as an insert, which is accommodated in a holder on the device housing so as to be capable of being replaced. An optimal possibility for advantageously accommodating different types of tap valves, such as Vitop or Rapak valves, for example, is created with the use of a replaceable insert, which can in particular be inserted or placed, for example, into an accommodation of a holder on the device housing. The tapping device can be retrofitted in an accordingly simple manner for the use of different "bag-in-box" packagings. The replaceable insert can be produced from a plastic material, which represents an advantageously simple and cost-efficient possibility of production.

Preferably, the operating element, which acts on the tap valve, is arranged on the valve accommodating bearing, which is embodied as a replaceable insert. By arranging the operating element directly on the replaceable insert, it is ensured that the operating element is optionally matched to the geometry of the tap valve and the tap mechanism thereof in view of the positioning and embodiment for each tap valve type, which is fixedly locked in the tapping device via the valve accommodating bearing, which is embodied as insert. An operation of the tap valve on the tapping device, which is always reliable, is ensured therewith. The operating element is in particular embodied so as to be movable to certain stationary parts of the valve accommodating bearing.

The valve accommodating bearing preferably encompasses guide surfaces, which run vertically at least across a predetermined section, for the tap valve housing, which moves downwards during the tapping by means of the operating element. This results in the advantage that the distance between the outlet of the tap valve and the beverage outlet on the tapping device is shortened in an advantageous manner during the tapping. The risk of contaminations caused by beverage splashes around the beverage outlet of the tapping device is thus minimized, so that the dimensions of the beverage outlet at the tapping device can be reduced in an advantageous manner. An interference-free lowering movement of the valve housing is ensured by means of the guide surfaces, specifically when using Vitop dispensing valves, the protruding wings of the valve piston of which are locked via the valve accommodating bearing. This type of operation represents a departure from its otherwise usual handling. In addition, an advantageously interference-free sliding of the tap valve is ensured during the lowering process at the guide surfaces of the valve accommodation bearing in combination with a valve accommodation bearing, which is embodied as insert and which in particular made of a plastic material.

The operating apparatus encompasses at least one valve operating mechanism, which leads through the device door, which represents a simple design possibility for operating the tap valve and thus for tapping beverages at the tapping device according to the invention. The operating apparatus thereby encompasses a trigger, which is embodied as tap button on the outside of the device door and which is coupled to the valve operating mechanism or which is a part thereof, respectively. The operating element according to the invention, which acts on a respective tap valve from above, can also be a part of the valve operating mechanism, which preferably encompasses two lever arms, which run at a predetermined angle relative to one another. The tap button of one of the lever arms, which is rotatably supported in the device door is preferred, wherein the tap button extends upwards in vertical direction. The other lever arm forms the operating element for the tap valve. The lever arms have a common pivot point, thus providing for the advantageous operation of the tap valve. An advantageous power gear ratio is furthermore created by means of the lever arms, which are stationary relative to one another, so that the operating comfort of the device according to the invention is further improved. The valve accommodating bearing and the valve operating mechanism are in particular guided in a forcibly-movable manner relative to one another, in particular via the connection of the device door, whereby the separation of the valve accommodating bearing and of the valve operating mechanism, which is routinely required for replacing empty "bag-in-box" packaging, is carried out by simply opening the device door.

The beverage outlet is in particular arranged in the device door, so that the tap valve and the beverage outlet are advantageously separated from one another by simply opening the device door. The areas around the beverage outlet on the inside of the device door as thus completely exposed, whereby cleaning measures, which might have to be carried out, can be taken care of much easier. In particular the entire inside of the device door becomes accessible for a necessary cleaning by opening the device door.

Provision is made according to a further development of the invention for the beverage outlet to be embodied as a housing opening, which surrounds a beverage stream in a contact-free manner. Possible germs or bacteria, which are transferred to the housing opening, can thus not reach the outlet of the tap valve and thus into the interior of the "bag-in-box" packaging by means of a direct contact by hand or by means of a beverage cup, which has already been used once. The shelf life of the beverages contained in the "bag-in-box" packaging is extended significantly through this. The tapping device according to the invention thus advantageously fulfils the strict hygienic standard "Hazard Analysis and Critical Control Point" HACCP, which is known in Europe. A direct contact of the beverage, which flows out of the "bag-in-box" packaging, with possible portions of pipes, which are possibly contaminated by residues of a previously tapped beverage, which remained in them, is furthermore always prevented in an advantageous manner.

The housing opening, which surrounds the beverage stream in a contact-free manner, is in particular equipped with an insert, which projects the outlet opening into the interior of the housing. By using an insert, which extends into the interior of the housing and into which the outlet of the tap valve itself projects during the operation of the tap valve, the hygiene in response to the tapping process on the tapping device according to the invention is further improved. Where applicable, beverage splatters thus only come into contact with the surface of the insert, which faces the tap valve, instead of with the inside of the device door. The insert is in particular embodied so as to be pipe or funnel-shaped, wherein the inner diameter is chosen to be so large that a contact of the insert by the beverage stream is virtually eliminated. The outer diameter of the insert and the housing opening together form a disengagable form-locking connection, for example. An optimal replaceability of the insert is thus ensured at the device door.

It further lies within the context of the invention that the device door encompasses at least one tap inlet, in which the beverage outlet is arranged. The device door preferably forms the entire front side of the tapping device, thus creating a closed front without disadvantageous gaps. The placement of a drinking vessel is made possible in the tap inlet, whereby the handling is further improved during the tapping. The contact area for the drinking vessel can be embodied as drip surface comprising bumps and depressions. The beverage outlet is preferably arranged in the upper, horizontal periphery of the tap inlet, so that a beverage stream, which passes through the beverage outlet, escapes in vertical direction. It goes without saying that it is also possible for the tap inlet to be arranged separately below a device door, which only embodies areas of the front side of the tapping device.

The operating element of the valve operating mechanism is a lever arm, which corresponds to the valve piston or valve housing head of the tap valve, thus creating a simple design possibility for operating the tap valve. The lever arm is in particular fixedly connected to the trigger, which is provided in the device door, via a pivot point. In response to the operation of the trigger vertically to the surface of the device door, the lever arm is pivoted downwards out of its approximately horizontal position and operates the part of the tap valve of the "bag-in-box" packaging, which is intended for this purpose through this. At least one return spring, by means of which a reset function of the tap valve and thus the automatic closing of the tap valve can be ensured reliably, can be assigned to the lever arm or to the trigger, respectively. The return spring is embodied, for example, as a flat spring, which is supported on the device door. The operating element, which is embodied as lever arm, can furthermore be equipped with a thorn-like appendage, which in particular simplifies the operation of the valve piston on a Rapak valve.

According to another further development of the invention, provision is made for a cooling aggregate to be assigned to the accommodating area for the "bag-in-box" packaging. The use or the arrangement, respectively, of a cooling aggregate in the accommodating area for a respective "bag-in-box" packaging, which is brought into its tapping position, provides for an advantageous chilling of the beverage, which is accommodated in the packaging. On the one hand, the beverages obtain an in particular constant drinking temperature and, on the other hand, the shelf life of an opened "bag-in-box" packaging can be extended additionally by the chilling. The cooling aggregate is in particular arranged in a wall of the accommodating area for the "bag-in-box" packaging, wherein the "bag-in-box" packaging can have both a direct contact with the cooling aggregate and an indirect chilling takes place via the air, which is located in the accommodating area. The accommodating surface for the "bag-in-box" packaging can furthermore encompass an orientation, which is inclined in the direction of the valve accommodating bearing, thus improving the automatic emptying thereof.

Exemplary embodiments of the invention, from which further inventive feature result, are illustrated in the drawing.

Figure 1:
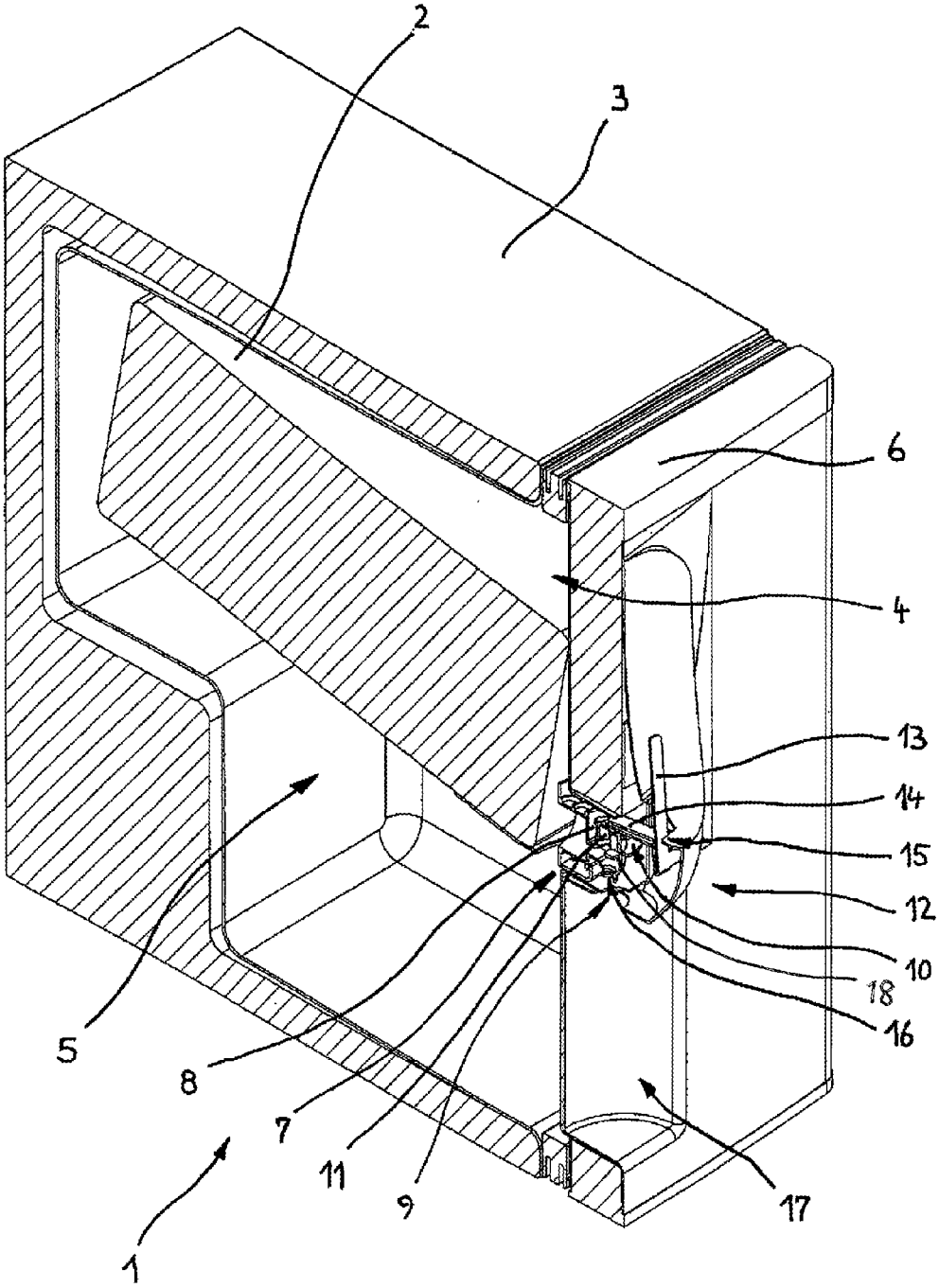
FIG. 1 shows a perspective view of a first tapping device according to invention in sectional view.

1 identifies a first embodiment of a tapping device according to the invention for at least one "bag-in-box" packaging 2, which encompasses a device housing 3, which completely surrounds the "bag-in-box" packaging 2. The device housing 3 encompasses a loading opening 4, via which an access to the accommodating area 5 for the "bag-in-box" packaging 2 is provided. The loading opening 4 is closed via a device door 6 of the device housing 3, whereby the device door 6 is accommodated in a pivotable manner on the stationary part of the device housing 3 via a hinge. The accommodating area 5 encompasses an accommodating surface, which is inclined downwards in the direction of the loading opening 4. The tapping device 1 is furthermore equipped with a valve accommodating bearing 7 for a tap valve 8 of the "bag-in-box" packaging 2, in which the tap valve 8 is accommodated in a predetermined position relative to a beverage outlet 9, which is assigned to the tap valve. The valve accommodating bearing 7 encompasses at least one bearing surface 10 for wings 18 of the tap valve 8 protruding on both sides of the valve housing 11. An operating apparatus 12 comprising a tap button 13 and comprising an operating element 14, which acts on the tap valve 8 from above, is furthermore arranged in the device door 6. The operating apparatus 12 encompasses a valve operating mechanism 15. To operate the tap valve, the tap button 13, which is embodied as lever arm, is to be pressed or moved, respectively, in the direction of the device door surface such that the operating means 14, which is also embodied as lever arm and which is rigidly connected to the tap button, moves downwards, for example in vertical direction with its free lever arm end and thus acts on the tap valve 8. Depending on the valve type, such as Vitop or Rapak dispenser valves, for example, the operating element acts on different areas of the tap valve. In response to the operation of the tap valve 8, the beverage stored in the "bag-in-box" packaging 2 flows from the valve outlet 16 through the beverage outlet 9 of the device housing 3 located therebelow, wherein the beverage outlet is embodied as a housing opening, which surrounds the beverage stream in a contact-free manner. The beverage outlet 9 is arranged on the upper side of a tap inlet 17, which is provided on the device door. The tapping device 1 furthermore encompasses a cooling aggregate, by means of which the beverage stored in the "bag-in-box" packaging can be cooled down to a desired drinking temperature.

Figure 2:
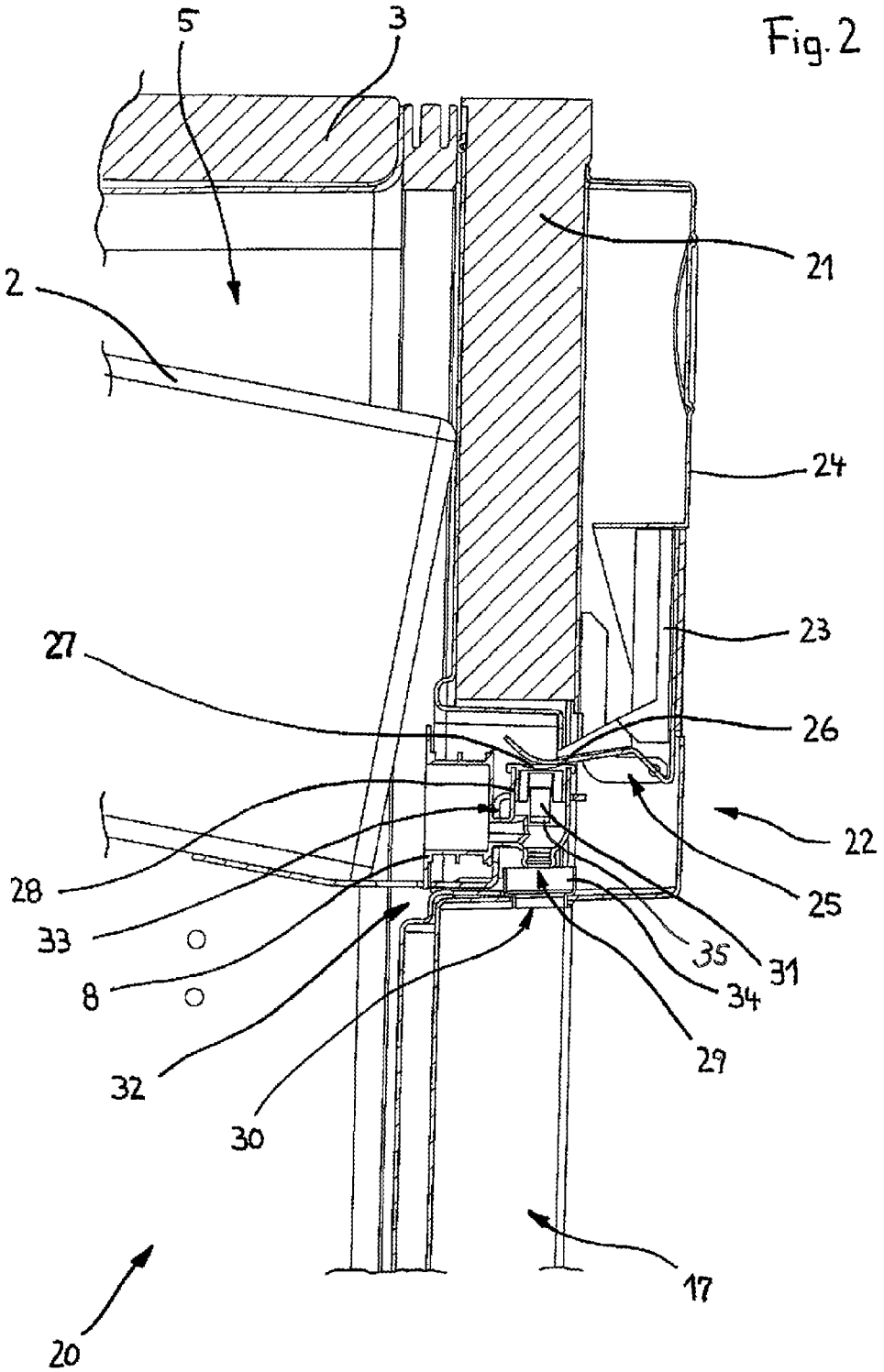
FIG. 2 shows a detailed view of the tapping area of a second tapping device according to the invention when the tap button is not operated.
Figure 3:
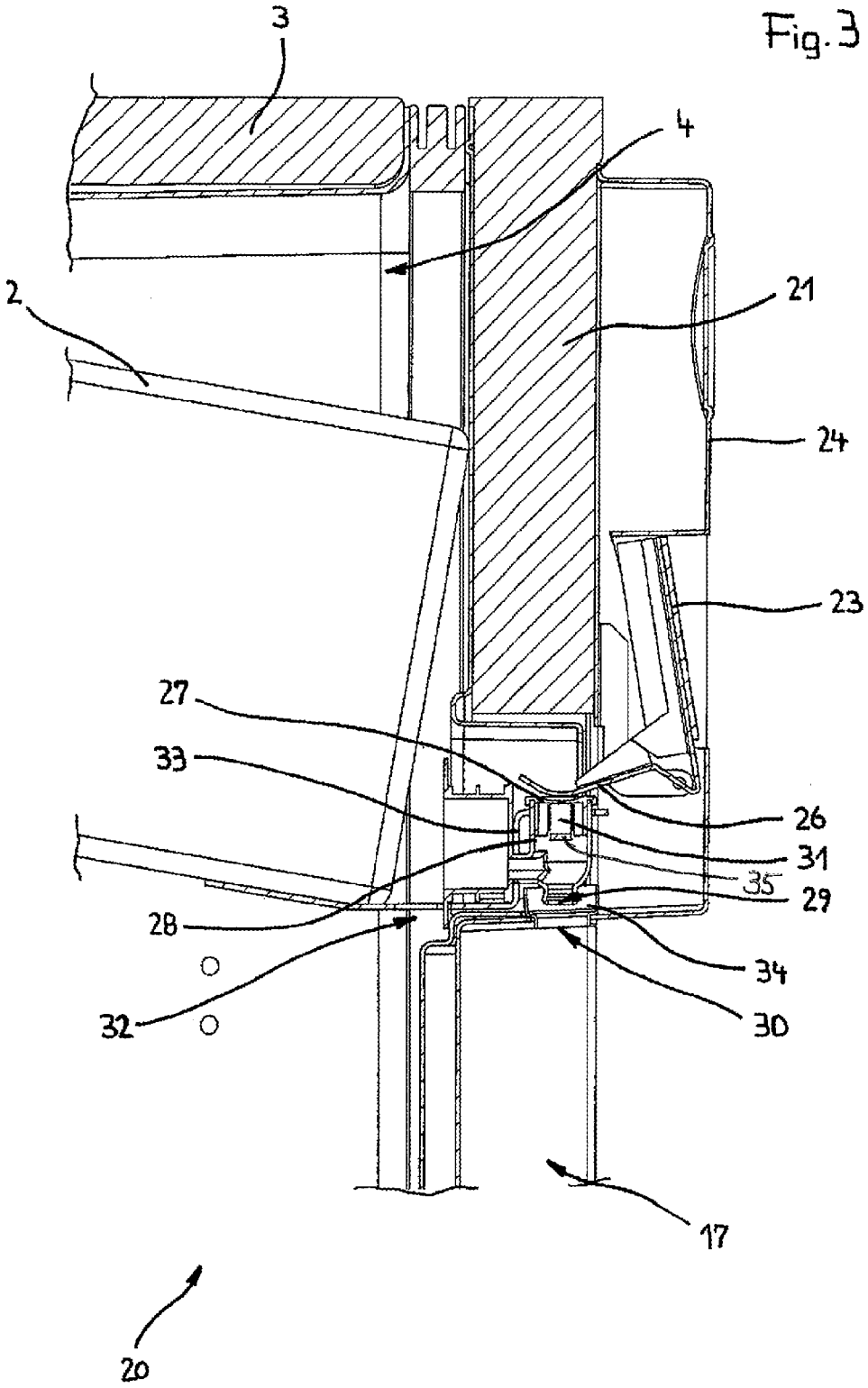
FIG. 3 shows a detailed view of the tapping device according to FIG. 2 when the tap button is operated.

FIGS. 2 and 3 show a further exemplary embodiment of a tapping device 20, the device door 21 of which is equipped with a further possible embodiment of an operating apparatus 22. The tap button 23 thereof is integrated completely into the front 24 of the device door 21. FIG. 2 shows the tap button, which is not operated and which is embodied as lever arm, and which assumes a vertical orientation when not being operated. By operating the tap button 23 (FIG. 3) vertically to the front 24 of the device door 21, the tap button 23 pivots about its pivot point, whereby the valve operating mechanism 25, which leads through the device door 21, simultaneously acts on the housing head 27 of the valve housing 28 by means of its operating element 26. In the case of the Vitop dispensing valve illustrated herein, the valve housing 28 thereof is moved downwards in vertical direction, whereby the valve outlet 29 thereof is displaced in the direction of the beverage outlet 30. The valve piston 31 with its protruding wings 35 is thereby locked on a predetermined height via the bearing surface 10 (FIG. 1) of the valve accommodating bearing 32. The displacement movement is possible by means of the guide surfaces 33 for the tap valve 8, which run vertically and which are embodied on the valve accommodating bearing 32. In addition, the beverage outlet 30 is equipped with a replaceable insert 34, which protrudes inwardly, by means of which contaminations caused by possible beverage splatters are avoided on the inside of the device door 21. The same components are identified with the same reference numerals.

The invention claimed is:

1. A tapping device for at least one "bag-in-box" packaging, which is equipped with a tap valve having a tap valve housing and wings protruding at least on both sides of the tap valve housing at a predetermined height, comprising at least one accommodating area for the "bag-in-box" packaging, wherein the accommodating area encompasses at least one loading opening, comprising at least one device door, which closes the loading opening of the accommodating area and which encompasses at least one trigger of an operating apparatus, which corresponds to the tap valve, and comprising at least one beverage outlet, which is associated with the tap valve, wherein provision is made in the area of the loading opening for at least one valve accommodating bearing, which has bearing surfaces for locking a position of the wings of the tap valve, wherein the valve accommodating bearing is embodied as an insert, which is accommodated in a holder on the device housing so as to be capable of being replaced, wherein the operating apparatus encompasses at least one operating element, which is embodied so as to be movable to stationary parts of the valve accommodating bearing and acts from above on the tap valve, wherein the operating element, which acts on the tap valve, is arranged on the valve accommodating bearing, which is embodied as a replaceable insert, and wherein the valve accommodating bearing encompasses at least guide surfaces, which run vertically, the guide surfaces allowing the tap valve housing to move in a downward direction as a result of the tapping by the operating element while vertical movement of the wings is restricted by the bearing surface.

2. The tapping device according to claim 1, wherein the operating apparatus encompasses at least one valve operating mechanism, which leads through the device door.

3. The tapping device according to claim 1, wherein the beverage outlet is arranged in the device door.

4. The tapping device according to claim 1, wherein the beverage outlet is embodied as a housing opening, which surrounds the beverage stream in a contact-free manner.

5. The tapping device according to claim 4, wherein the housing opening is equipped with an insert, which extends the outlet opening into the interior of the device housing.

6. The tapping device according to claim 1, wherein the device door encompasses at least one tap inlet, in which the beverage outlet is arranged.

7. The tapping device according to claim 2, wherein when the device door is closed, the operating element of the valve operating mechanism is a lever arm, which corresponds to the valve piston or to the housing head of the tap valve.

8. The tapping device according to claim 1, wherein a cooling aggregate is assigned to the accommodating area for the "bag-in-box" packaging.

* * * * *